United States Patent [19]

Yamashita

[11] 4,393,383

[45] Jul. 12, 1983

[54] MOBILE ANTENNA MOUNTING ASSEMBLY

[75] Inventor: Koji Yamashita, Tokyo, Japan

[73] Assignee: Nippon Electric Co., Ltd., Tokyo, Japan

[21] Appl. No.: 206,062

[22] Filed: Nov. 12, 1980

[30] Foreign Application Priority Data

Nov. 16, 1979 [JP] Japan ..... 54/159760[U]
Nov. 16, 1979 [JP] Japan ..... 54/159761[U]

[51] Int. Cl.[3] ..... H01Q 1/32; H01Q 1/10
[52] U.S. Cl. ..... 343/903; 343/889
[58] Field of Search ..... 343/715, 889, 903, 877

[56] References Cited

U.S. PATENT DOCUMENTS 2,558,763 7/1951 Lee ..... 343/715
3,253,799 5/1966 Till ..... 343/903
3,287,549 11/1966 Lantery ..... 343/715
4,086,596 4/1978 Gauss et al. ..... 343/715
4,223,314 9/1980 Tyrey et al. ..... 343/715

*Primary Examiner*—Eli Lieberman
*Attorney, Agent, or Firm*—Laff, Whitesel, Conte & Saret

[57] ABSTRACT

An antenna supporting base post, in which an antenna element is slidably fitted. The base is itself fitted through a body panel of a motor vehicle, where it is firmly secured in place with appropriate bushing means fitted over the base post and against the top and bottom surfaces of the body panel, by threading a tubular mount onto the top end of the base post. The tubular mount has a flexible body portion which enables the antenna element to tilt, when it is in its extended position, the tilt occurring freely under the impacting force of any external object accidentally hitting against the antenna element during vehicle travel.

5 Claims, 6 Drawing Figures

MOBILE ANTENNA MOUNTING ASSEMBLY

BACKGROUND OF THE INVENTION

1. Field of the Invention

This invention relates to antennas which are usable on a motor vehicle for mobile communication and, more particularly to mounting assemblies for such mobile antennas.

2. Description of the Prior Art

As a mobile antenna of the type concerned, a sleeve type antenna has heretofore been widely used particularly for high-frequency communications, as in an automotive telephone system. Such a sleeve type antenna is ordinarily mounted on a rear fender of the motor vehicle or in the vicinity thereof since, in that position, it is not electromagnetically influenced by the roof, or other body portion of the vehicle, to any substantial extent. An antenna mounted in this manner, however, involves the danger that the antenna element be broken, as when the vehicle is washed by an automatic car washer or is put into a garage. To cope with this situation, the antenna is constructed conjointly with a coaxial cable so as to be readily removed when desired. One example of such an antenna mounting assembly is disclosed in U.S. Pat. No. 4,173,761. Such a mounting assembly, however, involves the danger of the antenna element being stolen. If the mount is designed so that the antenna can be removed and remounted only by use of a particular tool means, there would be a substantial inconvenience in use of such an antenna unit.

One known form of antenna designed to prevent damage and theft thereof is a so-called rod antenna for car radio use. This rod antenna is slidingly telescoped to a closed position within the fender or other body panel of the vehicle to which the antenna is mounted. In this case, however, the antenna element must be formed of a rigid metal material as the electrical connection between the antenna element and the coaxial cable is effected by contactor means. Therefore, there is the danger of the antenna element being broken when struck against an obstacle or other object during travel of the vehicle. It is known to provide a spring at the mounting base of the antenna element as a means for preventing a breakage thereof. This mounting means, however, makes it difficult for the element to be removed from or stored inside the body panel of the vehicle, thus involving the danger that the element or the body panel might be damaged for example, in a car washing operation.

SUMMARY OF THE INVENTION

Accordingly, the present invention has for its object the provision of a mobile antenna mounting assembly, of the kind concerned, which is designed to overcome the previously encountered difficulties, as described above.

According to the present invention, a mobile antenna mounting assembly comprises an antenna element; a coaxial cable connected at one of its ends to the bottom end of the antenna element; and a hollow base post adapted to accommodate and support the antenna element, in a direction lengthwise thereof. An antenna-element fastening means is designed to affix the antenna element to a body panel of the motor vehicle. This fastening means includes a flexible member which enables the antenna element to tilt.

The above and other objects, features and advantages of the present invention will be apparent from the following description taken in conjunction with the accompanying drawings.

DESCRIPTION OF THE PREFERRED EMBODIMENTS

Figure 1:
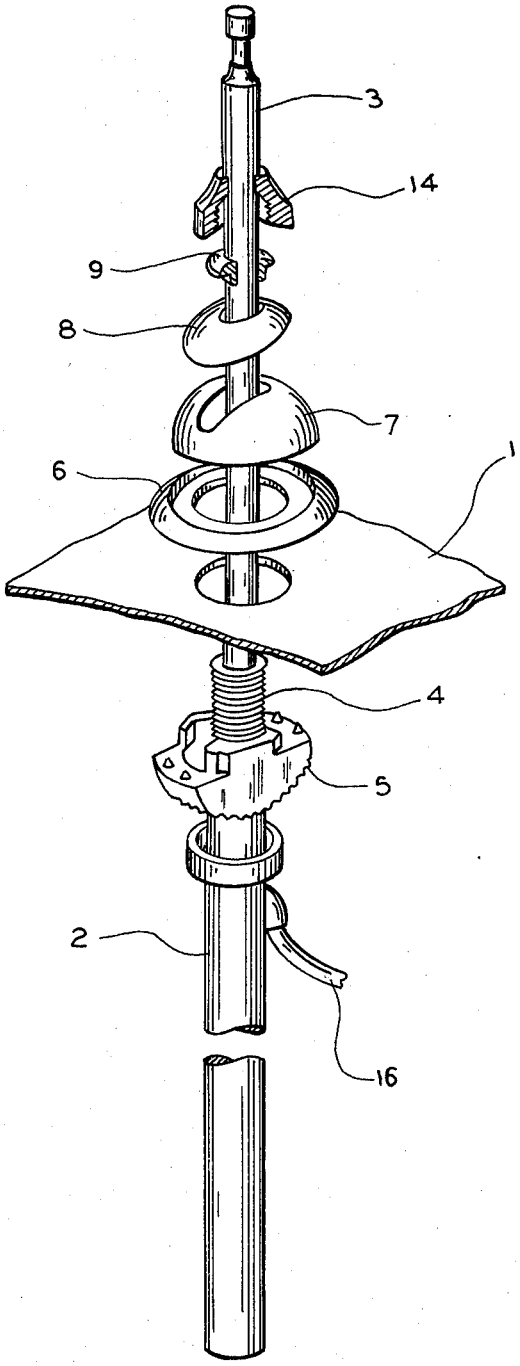
FIG. 1 (PRIOR ART)
FIG. 1 is an exploded perspective view of a conventional form of slide type antenna mounting assembly for car radio use.
Figure 2:
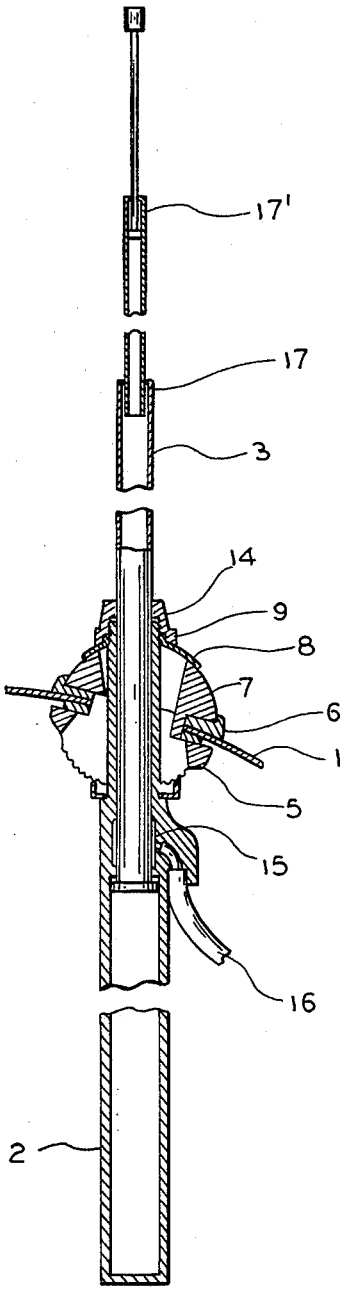
FIG. 2 (PRIOR ART)
FIG. 2 is a longitudinal cross-sectional view of the assembly shown in FIG. 1.

A description will first be made of the conventional form of antenna mounting assembly shown in FIGS. 1 and 2. As illustrated therein, an antenna element 3 is affixed together with a hollow supporting base post 2 to a mounting plate 1 (e.g., a fender plate of the motor vehicle) by a clamping nut 14. As seen in FIG. 2, the clamping nut 14 is threaded onto the top of the base post 2, in which the antenna element 3 is fitted. Nut 14 clamps hemispherical bushings 7 and 5 against the top and bottom surfaces of the mounting plate 1, through the intermediary of annular water-sealing pads 6 and 9. The hemispherical bushings 7 and 5 are both bored so as to allow angular adjustment of the antenna element 3 with respect to the mounting plate 1. Reference numeral 8 indicates a dished water-sealing piece interposed between the clamping nut 14 and hemispherical bushing 7.

On the supporting base post 2 is a contact element 15 for making an electrical connection from the antenna element 3 to a contact element 15 to which a coaxial cable 16 is connected, at one of its ends. The cable 16 is connected at its other end to a radio set (not shown). The antenna element 3 is comprised of a number of telescopically interfitted segments, as illustrated. Electrical connection between adjacent antenna segments is effected by means of contact elements 17 and 17' formed thereon.

In this connection, it will be apparent that, in order to establish electrical connection of the antenna element through the contact elements 15, 17 and 17', the antenna element must be formed of rigid metal wire or piping. Such an antenna element is capable of vertical lengthening and shortening but lacks flexibility in any lateral direction, involving the danger of being broken as when struck against an obstacle during vehicle travel.

Figure 3:
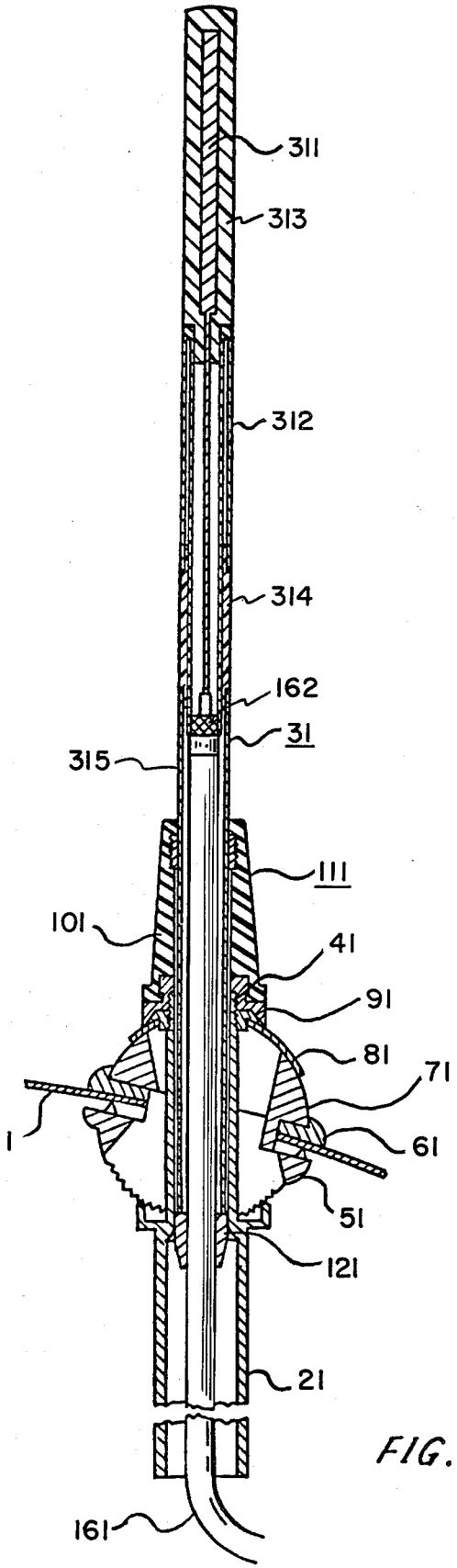
FIG. 3 is a view similar to FIG. 2, illustrating a preferred embodiment of the present invention.
Figure 4:
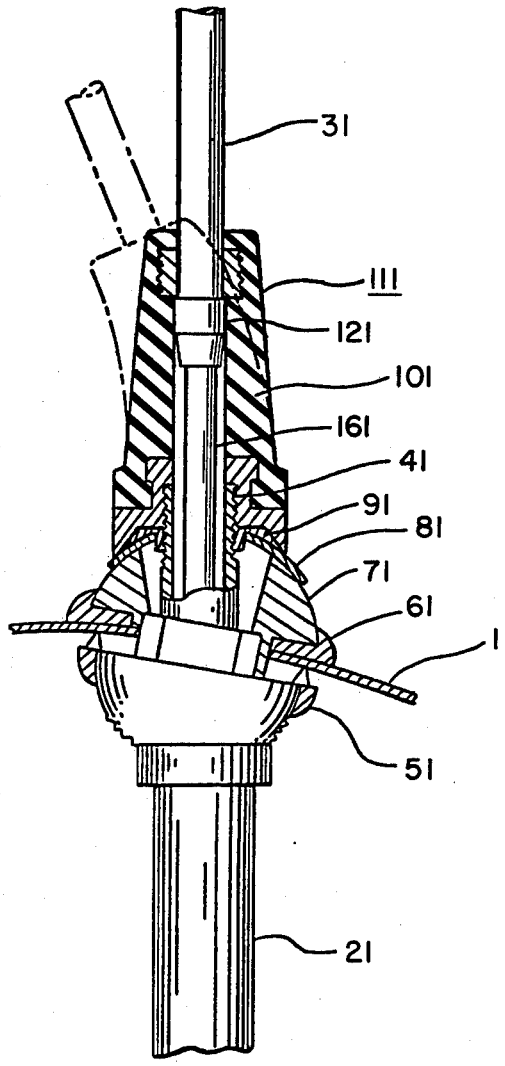
FIG. 4 is a fragmentary cross-sectional view, on an enlarged scale, illustrating the essential parts of the assembly shown in FIG. 3.

A description will next be made of a preferred embodiment of the present invention which is illustrated in FIG. 3 with the antenna element 31 partly extended and in FIG. 4 with the element completely extended. A base post 21, supporting the antenna element 31, is affixed to the mounting plate 1 through the intermediary of hemispherical bushings 71, 51 and water-sealing means 61, 81 and 91 by threading a tubular mount 111 onto the threaded top 41 of base post 21. The tubular mount 111 is fitted at its bottom with nut means for threadable engagement with the base post. A flexible body portion 101 is formed of elastic material such as rubber or soft plastic so that the antenna element 31, as completely extended, is freely tiltable from its normal vertical position, as indicated by the chain-dotted lines in FIG. 4. Connected to the bottom end 121 of antenna element 31 is a coaxial cable 161, which is vertically movable within the base post 21 as the antenna element 31 is moved vertically. Such a movement of the coaxial cable 161 can be effected smoothly, for example, by providing at the bottom end of supporting base post 21 a storage drum (not shown) in which the coaxial cable 161 is wound as the antenna element 31 is telescoped to a closed position.

In FIG. 3, reference numerals 311 and 312 indicate the radiating portion of the sleeve antenna and the folded portion of the coaxial feed line, respectively.

The radiating portion 311 is electrically connected at its lower end to the inner conductor of the coaxial cable 161 and is covered with a synthetic resin or plastic 313. The plastic portion 313 and the folded portion 312 are solidly fixed with respect to each other. The folded portion 312 is electrically connected to the outer conductor 162 of the coaxial cable 161 and is supported by a supporting portion 314 which is made of synthetic resin or plastic. The supporting portion 314 is further supported by an outer supporting metal tube 315. It may be understood from the foregoing that the antenna element 31 includes the outer supporting metal tube 315, the plastic supporting portion 314, the folded portion 312, the radiation portion 311 and the plastic covering 313. Since the antenna element 31 is solidly and directly connected at its bottom end 121 to the coaxial cable 161, the antenna element 31 can slide up and down by the paying-out and taking-up of the coaxial cable 161. When the antenna element 31 is completely extended upwardly (as shown in FIG. 4), it will be freely tiltable, as indicated by the dot-dashed lines in FIG. 4, because of the flexibility of both the elastic material 101 and the coaxial cable 16.

Figure 5:
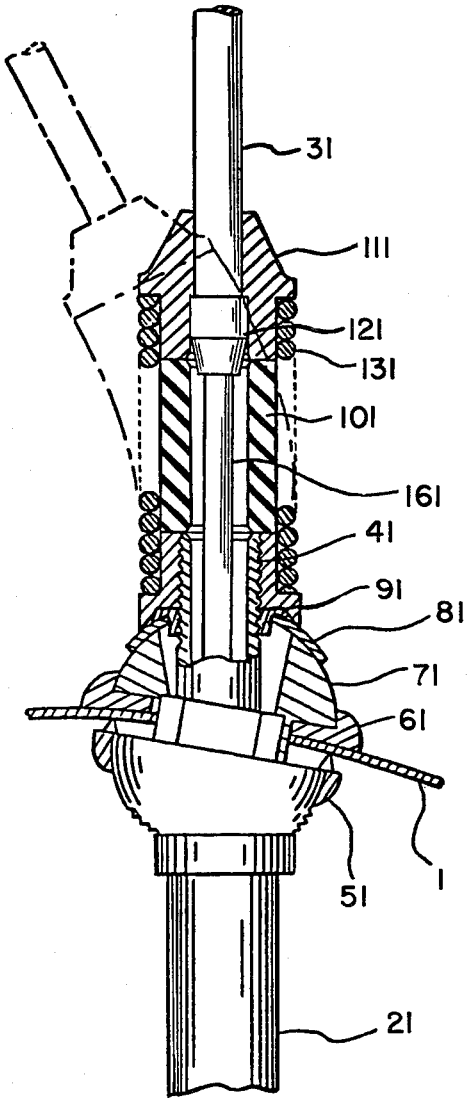
FIG. 5 is a view similar to FIG. 4, illustrating a modification of the structure shown in FIG. 4.

FIG. 5 illustrates a modification of the tubular mount which includes a coiled spring 131 fitted around the flexible body portion of the mount 111 for reinforcement thereof.

With the arrangement described, is will be noted that any external force applied transversely thereto, such as an impacting force accidentally exerted on this antenna during vehicle travel, only causes the flexible portion of the tubular mount to bend so that any breakage or the like damage to the antenna element is effectively prevented. Further, since the coaxial cable connected to the bottom end of the antenna element is vertically movable therewith, any appropriate electrical power drive means can be employed for vertical movement of the antenna element with extreme ease. An example of such power drive means is employed in a further embodiment of the present invention shown in FIG. 6.

Figure 6:
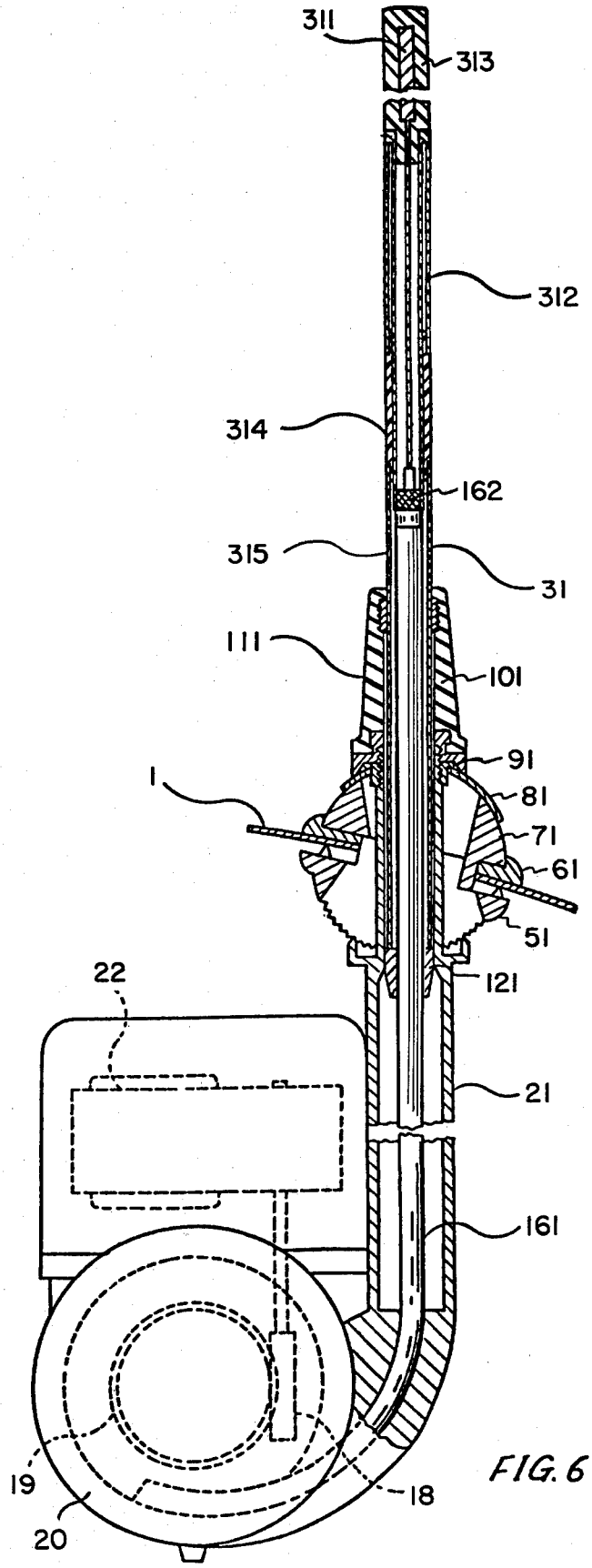
FIG. 6 is a longitudinal cross-sectional view, partly in perspective, of another preferred embodiment of the present invention.

In FIG. 6, the coaxial cable 161, connected to the bottom end of the antenna element 31, has its inner conductor covered with a pliable reinforcing material such as nylon so as to withstand any tractive force or buckling load as applied thereto when the antenna element 31 is driven for vertical movement. The coaxial cable 161 is arranged so as to be stored in a drum 20 or paid out therefrom under the drive of an electric motor 22. A worm 18 operatively connected with the motor 22 and a worm gear 19 held in mesh therewith are provided to drive a cable reel accommodated in the drum 20 and upon which the axial cable is wound. The motor 22 drives the antenna to either an extended or a retracted position.

What is claimed is:

1. A mobile antenna mount comprising a telescoping antenna means, upper and lower hemispherical bushing means having at least a bottom portion for positioning above and below a body panel for supporting said antenna, a bore extending through said bushing means with sufficient angular clearance to enable an adjustment of said antenna position on said panel, flexible coupling means between said antenna and said bushing means to enable a deflection of said antenna responsive to a mechanical force acting upon said antenna, flexible co-axial cable means free of contact pressure directly extending from the bottom of said telescoping antenna means for conveying signals between said antenna and equipment associated therewith, and an elongated encasing means extending downwardly from said lower hemispherical bushing for receiving said telescoping antenna when in a retracted position, said coaxial cable being movable within said encasing means to enable said antenna to telescope between an extended and a retracted position.

2. The antenna mount of claim 1 further comprises waterproof sealing means interposed between at least one of said bushing means and said body panel.

3. The antenna mount of claim 1 further comprises storage drum means for taking up or paying out said coaxial cable as said antenna telescopes.

4. The antenna of claim 1 further comprises power drive means for extending or retracting said telescoping means.

5. The antenna of any of the claims 1, 2, 3 and 4 further comprises pliable reinforcing means covering said coaxial cable for protecting it while said flexible coupling means is flexing.

* * * * *